US010760022B2

(12) United States Patent
Hsieh et al.

(10) Patent No.: US 10,760,022 B2
(45) Date of Patent: Sep. 1, 2020

(54) LOW CARBON BIO-OIL AND ITS MANUFACTURING METHOD

(71) Applicant: CPC Corporation, Taiwan, Kaohsiung (TW)

(72) Inventors: Tzu-Hsien Hsieh, Kaohsiung (TW); Yang-Chuang Chang, Kaohsiung (TW); Haw-Yeu Chuang, Kaohsiung (TW); Wen-Cheng Kang, Kaohsiung (TW)

(73) Assignee: CPC CORPORATION, TAIWAN, Kaohsiung (TW)

( * ) Notice: Subject to any disclaimer, the term of this patent is extended or adjusted under 35 U.S.C. 154(b) by 112 days.

(21) Appl. No.: 15/877,152

(22) Filed: Jan. 22, 2018

(65) Prior Publication Data

US 2019/0119591 A1 Apr. 25, 2019

(30) Foreign Application Priority Data

Oct. 25, 2017 (TW) ..... 106136768 A

(51) Int. Cl.

| | |
|---|---|
| ***C10L 1/188*** | (2006.01) |
| ***C10L 3/08*** | (2006.01) |
| ***C10L 1/182*** | (2006.01) |
| ***C10L 1/02*** | (2006.01) |
| ***C10G 19/04*** | (2006.01) |

(52) U.S. Cl.

CPC ..... *C10L 1/1881* (2013.01); *C10G 19/04* (2013.01); *C10L 1/02* (2013.01); *C10L 1/182* (2013.01); *C10L 3/08* (2013.01); *C10G 2300/1055* (2013.01); *C10G 2300/207* (2013.01); *C10G 2400/04* (2013.01); *C10L 2200/0254* (2013.01); *C10L 2200/0453* (2013.01); *C10L 2200/0476* (2013.01); *C10L 2230/14* (2013.01)

(58) Field of Classification Search

CPC combination set(s) only.
See application file for complete search history.

(56) References Cited

U.S. PATENT DOCUMENTS

| | | | | |
|---|---|---|---|---|
| 2012/0167451 | A1 | 7/2012 | Festuccia | |
| 2013/0143293 | A1* | 6/2013 | Rusek et al. | C12P 5/02 |
| 2013/0327980 | A1 | 12/2013 | Ray et al. | |
| 2015/0360189 | A1* | 12/2015 | Riska et al. | B01F 15/02 |

* cited by examiner

*Primary Examiner* — Ellen M McAvoy
*Assistant Examiner* — Chantel L Graham
(74) *Attorney, Agent, or Firm* — Muncy, Geissler, Olds & Lowe, P.C.

(57) ABSTRACT

In order to develop a high combustion heat and stable bio-oil for safer transportation. The present invention discloses a low carbon bio-oil, selected from the group consisting of a thermo-chemical oil product, a fatty acid containing bio-oil and a bio-alcohol. The invention also discloses a preparation method of preparing the low carbon bio-oil.

14 Claims, 1 Drawing Sheet

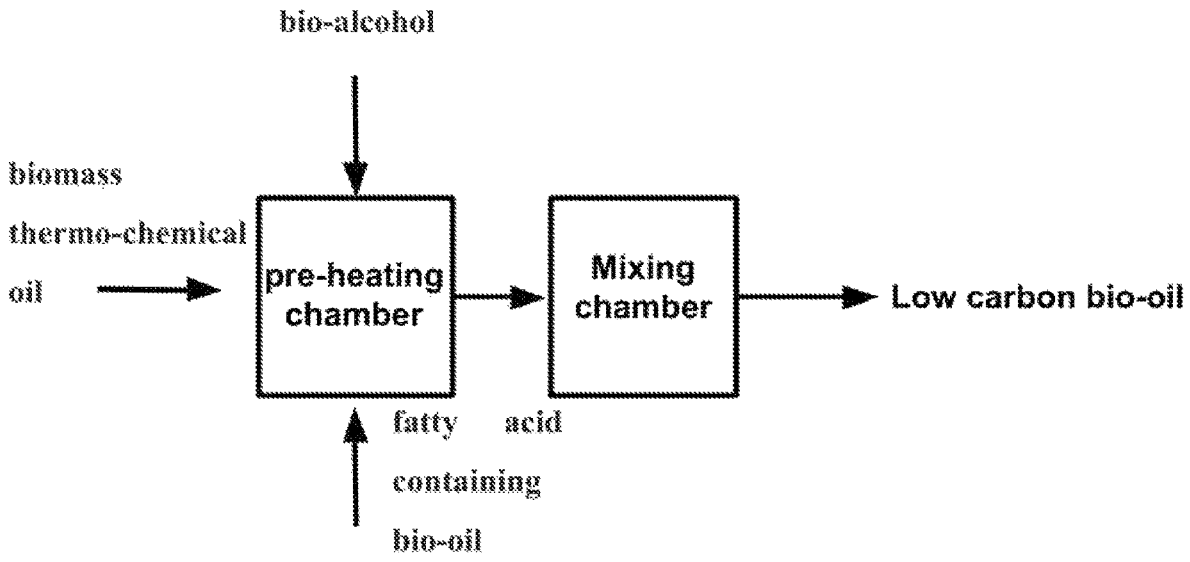
bio-alcohol
biomass
thermo-chemical
oil
pre-heating chamber
Mixing chamber
Low carbon bio-oil
fatty acid
containing
bio-oil

LOW CARBON BIO-OIL AND ITS MANUFACTURING METHOD

CROSS-REFERENCE TO RELATED APPLICATIONS

This non-provisional application claims priority under 35 U.S.C. § 119 on Patent Application No. TW106136768 filed in Taiwan, Republic of China Oct. 25, 2017, the entire contents of which are hereby incorporated by reference in its entirety.

FIELD OF THE INVENTION

The present invention discloses a low carbon bio-oil, selected from the group consisting of a thermo-chemical oil product, a fatty acid containing bio-oil and a bio-alcohol. The invention also discloses a preparation method of preparing the low carbon bio-oil.

BACKGROUND OF THE INVENTION

Biofuel refers to a solid, liquid, or gas that is made of, or extracted from a biomass. Biomass can be converted into easy-to-use, energy-containing substances in three different transformations, including: thermal, chemical, and biochemical. Biofuel oil is an important renewable energy source. Currently, about 3 million tons of fuel oil is used in Taiwan. The heating value of biofuel oil is about half of that of fuel oil, and biomass pyrolysis oil market is about 300,000 tons of if we replaced 5% fuel oil. As the trend of traditional coal and oil use slows down due to the trend of carbon reduction, biofuels will play an important role in reducing carbon emissions in the future. However, thermochemical technologies can handle a large amount of biomass wastes and convert them into fuels.

In the prior art, Artur Pozarlik et al. conducted a study on the mixing of ethanol, biomass pyrolysis oil, diesel oil or butanol, pyrolysis oil and diesel oil. The mixture of ethanol and pyrolysis oil can be mixed about 10% with diesel, and the mixture of butanol and pyrolysis oil can be mixed about 50% with diesel. The results show that the mutual solubility of butanol is better than that of ethanol; US 20120167451 A1 indicate emulsifies the biomass pyrolysis oil into a dispersed phase through alcohols, water and surfactants to stabilize the biomass pyrolysis oil properties. However, the cost of the surface active agents is high and the heating value of water and alcohol is low, which makes the energy density of the fuel less ideal. US 20130327980 A1 states that the oil after mixed with the biomass pyrolysis oil, surfactant and the lipid can be used as fuel or as feedstock as follow-up process to produce oil.

However, the heating value of the bio-fuel from the conventional thermochemical technique is lower than other bio-fuel, and the bio-fuel from the traditional thermochemical technique is acidity. Therefore, the bio-fuel from the conventional thermochemical technique need to be modified by some adjustment to be applied on conventional heating equipment. Besides, the stability of the bio-fuel from the conventional thermochemical technology is poor than other bio-fuel, which makes it not able to transported under higher than room temperature.

However, by in aspect of chemical structure, the solubility of the fatty acids in bio-thermal chemical oil is higher than fuel oil, and the heating value of the fatty acid is twice as high as the bio-thermal chemical oil. It is expected that the heating value would be enhanced if the oils were mixed with some specific bio-fuel in specific ratio. Therefore, the present invention, combines the concept of blending solvent to stabilize the biomass thermal chemical oil, proposes the use of bio-alcohol and fatty acid-rich waste biomass oil to improve the bio-thermal chemical stability and heating value. Besides, the present invention intends to simplify the blending process, thereby reducing the fuel costs.

SUMMARY OF THE INVENTION

Accordingly, the present invention provides a low-carbon bio-oil selected from the group consisting of a biomass thermo-chemical oil, a fatty acid-rich bio-oil, and bio-alcohol, wherein a range of high heat combustion for the low-carbon bio-oil is 3000-7000 cal/g.

In one of the embodiments of the present invention, the weight percentage of the fatty acid-rich bio-oil of the low-carbon bio-oil is less than 20%.

In one of the embodiments of the present invention, the weight percentage of the bio-alcohol of the low-carbon bio-oil is 0.1-10%.

In one of the embodiments of the present invention, the biomass thermo-chemical oil is a biomass pyrolysis oil, a carbonized tar, or liquid product after carbonization, pyrolysis or gasification.

In one of the embodiments of the present invention, the fatty acid-rich bio-oil is a black high acid value oils, a white high acid value oil or a palm fatty acid distillate (PFAD).

In one of the embodiments of the present invention, the weight ratio of the biomass pyrolysis oil to the black high acid value oil is 1:1.

In one of the embodiments of the present invention, the weight ratio of the biomass pyrolysis oil to the white high acid value oil is 3:1.

In one of the embodiments of the present invention, the weight ratio of the carbonized tar to the black high acid value oil is 3:1.

In one of the embodiments of the present invention, the weight ratio of the carbonized tar to the white high acid value oil is 3:1.

In one of the embodiments of the present invention, the fatty acid-rich bio-oil is obtained from a waste oil after manufacture process.

In one of the embodiments of the present invention, the alcohol is ethanol, butanol or a higher alcohol.

In one of the embodiments of the present invention, the weight ratio of the biomass pyrolysis oil, the black high acid value oil and the bio-alcohol is 15:5:1.

The low-carbon bio-oil of claim 11, wherein the weight ratio of the biomass pyrolysis oil, the white high acid value oil and the bio-alcohol is 15:5:2.

To solve the problem, the present invention provides a method for producing a low-carbon bio-oil of claim 1, which comprises the steps of: (a) obtaining an oil mixture selected from the group consisting of a biomass thermo-chemical oil, a fatty acid-rich bio-oil, and bio-alcohol: (b) heating the oil mixture to 40-90° C.; and (c) settling the mixture at room temperature to obtain a low-carbon bio-oil.

Based on the above description, the present invention further tests different blending ratio of thermochemical oils, fatty acid-rich waste biomass pyrolysis oil and bio-alcohol. The present invention has the high heat value and high stability of low-carbon fuel oil, which can effectively improve the problem of low combustion calorific value and acidity of traditional bio thermochemical oils, and difficult to transport with high temperature etc.

BRIEF DESCRIPTION OF THE DRAWINGS

The Sole FIGURE shows the method for producing a low-carbon bio-oil of the present invention.

DETAILED DESCRIPTION OF THE INVENTION

By way of illustration, the specific embodiments will be disclosed in detail below, however, the features of the invention are not limited to these embodiments.

The present invention provides a low-carbon bio-oil which is selected from the group consisting of biomass thermo-chemical oil, a fatty acid-rich bio-oil, and bio-alcohol, wherein the characteristics of the raw material used in the examples herein are as shown in Table 1.

TABLE 1 characteristics of the raw material used in the examples

| item | biomass pyrolysis oil | black high acid value oil | white high acid value oil | carbonized tar |
|---|---|---|---|---|
| Weight percentage g/cm$^3$ | 1.137 | 0.9024 | 0.9806 | 1.19 |
| Ash content wt % | 0.1734 | 0.0751 | 0.6986 | 0.113 |
| higher heating value (HHV) cal/g | 3791 | 9213 | 7390 | 4167 |
| Viscosity 50° C., cSt | 5.98 | 9.32 | 150.4 | 9.53 |
| Flash point ° C. | 39 | 99 | 87 | 145 |

The present invention provides a method for producing a low-carbon bio-oil. Please refer to the Sole FIGURE, which comprises the steps of: mixing a biomass thermo-chemical oil, a fatty acid-rich bio-oil and bio-alcohol in a specific ratio in a pre-heating chamber, then heating the oil mixture to 40-90° C.; and transporting the oil mixture into the pre-heating chamber, keep the temperature same as the pre-heating chamber, then mixing the oil mixture for 2 hours: settling the oil mixture at room temperature to obtain a low-carbon bio-oil.

Example 1

15 kg biomass pyrolysis oil and 15 kg black high acid value oil is mixed and settling in room temperature, then take out as upper, middle and lower three sections. Then take out 500 g for each section to carry out specific gravity, ash content, higher heating value and viscosity analysis. The first analysis sample is shaken before sampling and is analyzed again due to the large difference. According to the data, 15 kg of biomass pyrolysis oil and 15 kg black high acid value oil are mixed and the phase separation is more serious (as shown in Table 2).

TABLE 2

Analysis result of example 1

| | item | | | | | |
|---|---|---|---|---|---|---|
| | 1-1 | | | 1-2 | | |
| | Upper section | Middle section | Lower section | Upper section | Middle section | Lower section |
| Weight percentage g/cm$^3$ | 1.149 | 0.9170 | 1.162 | 0.9182 | 0.9182 | 1.12 |
| Ash content wt % | 0.2206 | 0.028 | 0.4043 | 0.0109 | 0.293 | 0.2822 |
| higher heating value (HHV) cal/g | 3614 | 9068 | 2534 | 8899 | 8858 | Cannot be lit |
| Viscosity 50° C., cSt | 6.91 | 8.4 | 7.05 | 8.5 | 8.47 | 7.95 |

Example 2

1125 g biomass pyrolysis oil and 375 g white high acid value oil is heated to 60° C., and then mixed and settling in room temperature, then take out as upper, middle and lower three sections. Then take out 500 g for each section to carry out specific gravity, ash content, higher heating value and viscosity analysis. From the test result of weight percentage and ash content, the properties of upper section is close to white high acid value oil, and the properties of lower section is close to biomass pyrolysis oil. Higher heating value (HHV) shows large difference of different section. (as shown in Table 3).

TABLE 3

Analysis result of example 2

| item | 2 | | |
|---|---|---|---|
| | Upper section | Middle section | Lower section |
| Weight percentage g/cm$^3$ | 0.939 | 1.111 | 1.125 |
| Ash content wt % | 0.0109 | 0.1543 | 0.2699 |
| higher heating value (HHV) cal/g | 3754 | 3313 | 3338 |
| Viscosity 50° C., cSt | 4.93 | 4.8 | 4.98 |

Example 3

1125 g carbonized tar and 375 g white high acid value oil is heated to 60° C., and then mixed and settling in room temperature, then take out as upper, middle and lower three sections. Then take out 500 g for each section to carry out specific gravity, ash content, higher heating value and viscosity analysis. From the test result of weight percentage and ash content, the properties of upper section are close to white high acid value oil, and the properties of lower section is close to biomass pyrolysis oil. Higher heating value (HHV) shows large difference of different section. (as shown in Table 4).

TABLE 4

| Analysis result of example 3 | | | |
|---|---|---|---|
| | 3 | | |
| item | Upper section | Middle section | Lower section |
| Weight percentage g/cm$^3$ | 0.9745 | 1.142 | 1.161 |
| Ash content wt % | 0.4644 | 0.4528 | 0.2327 |
| higher heating value (HHV) cal/g | 3370 | 3413 | 3838 |
| Viscosity 50° C., cSt | 8.93 | 7.05 | 7.14 |

Example 4

375 g carbonized tar and 125 g white high acid value oil is heated to 60° C., and then mixed and settling in room temperature, then take out as upper, middle and lower three sections. Then take out 500 g for each section to carry out specific gravity, ash content, higher heating value and viscosity analysis. From the test result of data, the properties are close to original oil, which means the carbonized tar mixed well with white high acid value oil. (as shown in Table 5).

TABLE 5

| Analysis result of example 4 | |
|---|---|
| Item | 4 |
| Weight percentage g/cm$^3$ | 1.109 |
| Ash content wt % | 0.3341 |
| higher heating value (HHV) cal/g | 3838 |
| Viscosity 50° C., cSt | 7.51 |

Example 5

375 g carbonized tar and 125 g black high acid value oil is heated to 60° C., and then mixed and settling in room temperature, then take out as upper, middle and lower three sections. Then take out 500 g for each section to carry out specific gravity, ash content, higher heating value and viscosity analysis. From the test result of higher heating value (HHV), the properties are different from original oil, which means the carbonized tar cannot mixed well with black high acid value oil. (as shown in Table 6).

TABLE 6

| Analysis result of example 5 | |
|---|---|
| Item | 5 |
| Weight percentage g/cm$^3$ | 1.142 |
| Ash content wt % | 0.4528 |
| higher heating value (HHV) cal/g | 8982 |
| Viscosity 50° C., cSt | 9.6 |

Example 6

1125 g biomass pyrolysis oil, 375 g black high acid value oil and 75 g alcohol are heated to 60° C., and then mixed and settling in room temperature, then take out as upper, middle and lower three sections. Then take out 500 g for each section to carry out specific gravity, ash content, higher heating value and viscosity analysis. From the test result of higher heating value (HHV), the alcohol can enhance the uniformity of overall oil. (as shown in Table 7).

TABLE 7

| Analysis result of example 6 | | | |
|---|---|---|---|
| | 6 | | |
| item | Upper section | Middle section | Lower section |
| Weight percentage g/cm3 | 0.9779 | 1.049 | 1.057 |
| Ash content wt % | 0.1153 | 0.085 | 0.0898 |
| higher heating value (HHV) cal/g | 4050 | 4084 | 4288 |
| Viscosity 50° C., cSt | 6.8 | 3.57 | 3.48 |

Example 7

1125 g biomass pyrolysis oil, 375 g black high acid value oil and 75 g alcohol are heated to 60° C., and then mixed and settling in room temperature, then take out as upper, middle and lower three sections. Then take out 500 g for each section to carry out specific gravity, ash content, higher heating value and viscosity analysis. From the test result of higher heating value (HHV), the alcohol can enhance the uniformity of overall oil. (as shown in Table 8).

TABLE 8

| Analysis result of example 7 | | | |
|---|---|---|---|
| | 7 | | |
| item | Upper section | Middle section | Lower section |
| Weight percentage g/cm$^3$ | 0.9779 | 1.077 | 1.078 |
| Ash content wt % | 0.4417 | 0.4241 | 0.4230 |
| higher heating value (HHV) cal/g | 3930 | 4049 | 4115 |
| Viscosity 50° C., cSt | 6.67 | 4.2 | 4.24 |

Although the present invention has been described in terms of specific exemplary embodiments and examples, it will be appreciated that the embodiments disclosed herein are for illustrative purposes only and various modifications and alterations might be made by those skilled in the art without departing from the spirit and scope of the invention as set forth in the following claims.

What is claimed is:

1. A low-carbon bio-oil selected from the group consisting of a biomass thermo-chemical oil, a fatty acid-rich bio-oil, and bio-alcohol, wherein a range of high heat combustion for the low-carbon bio-oil is 3000-7000 cal/g.

2. The low-carbon bio-oil of claim 1, wherein the weight percentage of the fatty acid-rich bio-oil of the low-carbon bio-oil is 1-20%.

3. The low-carbon bio-oil of claim 1, wherein the weight percentage of the bio-alcohol of the low-carbon bio-oil is 0.1-10%.

4. The low-carbon bio-oil of claim 1, wherein the biomass thermo-chemical oil is a biomass pyrolysis oil, a carbonized tar, a liquid product after carbonization, pyrolysis or gasification.

5. The low-carbon bio-oil of claim 4, wherein the fatty acid-rich bio-oil is a black high acid value oils, a white high acid value oil or a palm fatty acid distillate (PFAD).

6. The low-carbon bio-oil of claim 5, wherein the weight ratio of the biomass pyrolysis oil to the black high acid value oil is 1:1.

7. The low-carbon bio-oil of claim 5, wherein the weight ratio of the biomass pyrolysis oil to the white high acid value oil is 3:1.

8. The low-carbon bio-oil of claim 5, wherein the weight ratio of the carbonized tar to the black high acid value oil is 3:1.

9. The low-carbon bio-oil of claim 5, wherein the weight ratio of the carbonized tar to the white high acid value oil is 3:1.

10. The low-carbon bio-oil of claim 5, wherein the fatty acid-rich bio-oil is obtained from a waste oil after manufacture process.

11. The low-carbon bio-oil of claim 5, wherein the bio-alcohol is ethanol, butanol or a higher alcohol.

12. The low-carbon bio-oil of claim 11, wherein the weight ratio of the biomass pyrolysis oil, the black high acid value oil and the bio-alcohol is 15:5:1.

13. The low-carbon bio-oil of claim 11, wherein the weight ratio of the biomass pyrolysis oil, the white high acid value oil and the bio-alcohol is 15:5:2.

14. A method for producing a low-carbon bio-oil of claim 1, which comprises the steps of:

a) obtaining an oil mixture selected from the group consisting of a biomass thermo-chemical oil, a fatty acid-rich bio-oil, and bio-alcohol;

b) heating the oil mixture to 40-90° C.; and c) settling the mixture at room temperature to obtain a low-carbon bio-oil.

* * * * *